US012779309B2

(12) United States Patent
Wang

(10) Patent No.: US 12,779,309 B2
(45) Date of Patent: Nov. 3, 2026

(54) BASKETBALL STAND

(71) Applicant: Benn Wang, Taichung City (TW)

(72) Inventor: Benn Wang, Taichung City (TW)

( * ) Notice: Subject to any disclaimer, the term of this patent is extended or adjusted under 35 U.S.C. 154(b) by 368 days.

(21) Appl. No.: 18/515,117

(22) Filed: Nov. 20, 2023

(65) Prior Publication Data

US 2025/0161780 A1 May 22, 2025

(51) Int. Cl.
*A63B 71/02* (2006.01)
*A63B 63/08* (2006.01)

(52) U.S. Cl.
CPC ..... *A63B 71/023* (2013.01); *A63B 63/083* (2013.01); *A63B 2071/026* (2013.01); *A63B 2210/50* (2013.01)

(58) Field of Classification Search
CPC . A63B 63/083; A63B 2210/50; A63B 71/023; A63B 2071/026; F16M 11/247
USPC ..... 248/170, 171, 346.5
See application file for complete search history.

(56) References Cited

U.S. PATENT DOCUMENTS 5,618,039 A * 4/1997 Tsai ..... A63B 69/0091 473/436
5,964,524 A * 10/1999 Qian ..... F21V 21/06 362/431
5,979,844 A * 11/1999 Hopkins ..... E01F 9/692 248/910
6,159,111 A * 12/2000 Purcell ..... A63B 69/0071 473/472
12,352,063 B1 * 7/2025 Arnold, Sr. ..... E04H 15/58
2005/0153794 A1 * 7/2005 LaPointe ..... A63B 69/0084 473/429
2005/0255946 A1 * 11/2005 Liu ..... A63B 63/083 473/481
2013/0040762 A1 * 2/2013 Swingle ..... A63B 63/08 473/422
2013/0178313 A1 * 7/2013 Meier ..... A63B 69/0002 473/417
2014/0151527 A1 * 6/2014 Sawhney ..... F16M 11/247 248/125.1
2020/0306604 A1 * 10/2020 Zimmer ..... A63B 71/023

* cited by examiner

*Primary Examiner* — Joshua T Kennedy
(74) *Attorney, Agent, or Firm* — Daniel Polk; Darryl Scott

(57) ABSTRACT

A basketball stand comprises a main pole and a base assembly, the base assembly is disposed on a bottom side of the main pole and has at least three support poles, at least three support pads and at least three weight blocks, the support poles are annularly disposed around the main pole, a bottom end of each of the support poles is capable of expanding outwardly or retracting inwardly; the support pads are respectively pivotally connected to the bottom ends of the support poles; the weight blocks are respectively installed on the support pads. When the base assembly is unfolded, the support poles are in contact with the ground via the support pads.

14 Claims, 15 Drawing Sheets

BASKETBALL STAND

FIELD OF THE INVENTION

The invention relates to a basketball stand, the basketball stand has a counterweight design.

DESCRIPTION OF THE RELATED ART

Basketball is a popular sport and leisure activity around the world. In order to facilitate playing basketball in various places, such as courtyards, open spaces, green fields, etc., the industry has developed portable or movable basketball stands for using by basketball hobbyists or general households.

However, most of the existing portable or movable basketball stands have an issue of unstable center of gravity and are prone to tipping, which affects the enjoyment of use.

In addition, it is not easy to erect or fold this type of basketball stand, and the connection structure between its components is not stable and stable and is prone to loosening or shaking.

SUMMARY OF THE INVENTION

An object of the invention is to provide a movable basketball stand, a base of the basketball stand has a counterweight design to make its center of gravity stable and it is not easy to tip over during use.

Another object of the invention is to provide the basketball stand, and it is easy to erect or fold the base of the basketball stand.

Yet another object of the invention is to provide the basketball stand with a firm and stable overall structure for facilitating using.

A basketball stand provided by the invention comprises:

- a main pole;
- a backboard and a basket disposed at a top end of the main pole; and
- a base assembly installed on a bottom side of the main pole, and having at least three support poles, at least three support pads and at least three weight blocks, wherein:
  - the support poles are annularly disposed around the main pole at intervals, a bottom end of each of the support poles is capable of expanding outwardly or retracting inwardly;
  - the support pads are respectively pivotally connected to the bottom ends of the support poles;
  - the weight blocks are respectively installed on the support pads; and
- the base assembly can be unfolded or folded, when the support poles are expanded, the support pads contact the ground.

With the above design, when the base assembly is unfolded, the three support pads form a large bottom area, and the base assembly has a counterweight design, each of the support pads is equipped with the weight block to increase a weight of the base assembly, enabling the basketball stand to have a lower center of gravity and a more firm and stable bottom, thus it is less likely to tip over during use.

Preferably, each of the support pads is provided with at least one accommodating chamber; each of the weight blocks can be placed into and taken out of the accommodating chamber.

Preferably, each of the accommodating chambers is recessed inwardly from a top surface of the support pad; each of the weight blocks is placed into the accommodating chamber from the top surface of the support pad.

Preferably, a protrusion is located in the accommodating chamber; the bottom end of each of the support poles is pivotally connected to the protrusion; each of the weight blocks is U-shaped to match a shape of the accommodating chamber, when the weight block is placed into the accommodating chamber, the protrusion is surrounded.

Preferably, one side of the accommodating chamber of each of the support pads forms an open side, and the open side faces the main pole.

Preferably, the base assembly further comprises a fixed seat, a sliding seat and at least three connecting rods; the fixed seat is fixedly disposed on a bottom end of the main pole; the sliding seat is sleeved on the main pole and located above the fixed seat, and capable of sliding along a longitudinal direction of the main pole; a top end of each of the support poles is pivotally connected to the sliding seat; one end of each of the connecting rods is pivotally connected to the fixed seat, and another end thereof is pivotally connected to one of the support poles.

Preferably, cross-sections of an inner pole and an outer pole of the main pole are in the shape of a triangular shield, three sides of the inner pole and the outer pole are convex arcuate surfaces, at least one of the sides of the inner pole is provided with a longitudinal embedding slot; at least one of the sides of the outer pole has a longitudinal convex strip, each of the sides of the inner pole is in contact with each of the sides of the outer pole, and the convex strip is embedded in the embedding slot. Thereby, a connection structure between the inner pole and the outer pole is firm and stable and it is uneasy to loosen.

Preferably, an outer peripheral surface of the outer pole is provided with at least one longitudinal embedding slot; the sliding seat is a hollow cylindrical body, an inner peripheral surface thereof is provided with at least one convex portion, the sliding seat is sleeved on the outer pole; the convex portion is embedded with the embedding slot. Thereby, a connection structure between the sliding seat and the outer pole is stable, no matter the sliding seat is stationary or moves on the outer pole, it is not easy to loosen or shake.

Preferably, the basketball stand further comprises a bracket, the bracket has a front end and a rear end, the rear end is connected to the main pole; at least one plug post is provided at the front end of the bracket; a bottom edge of the backboard is provided with at least one inserting slot penetrating through a front side and a back side of the backboard; a rear end of the basket has a connecting plate; the plug post of the bracket is inserted into the inserting slot from the back side of the backboard; the connecting plate of the basket is disposed on the front side of the backboard; and one connecting element or a plurality of connecting elements is/are connected to the connecting plate of the basket and the plug post of the bracket. Thereby, stable connection structures are provided between the bracket, the backboard and the basket.

Preferably, a peripheral wall of the front end of the bracket forms a non-circular periphery; the rear end of the basket has a connecting plate; the front side of the backboard is provided with a first position-limiting portion, the back side thereof is provided with a second position-limiting portion, a geometric shape of the first position-limiting portion corresponds to a geometric shape of the connecting plate; a geometric shape of the second position-limiting portion corresponds to a geometric shape of a periphery of the bracket; the connecting plate of the basket and the first position-limiting portion are engaged with each other; the periphery of the front end of the bracket and the second position-limiting portion are engaged with each other; and at least one connecting element is connected to the connecting plate and the front end of the bracket. Thereby, stable connection structures are provided between the bracket, the backboard and the basket.

BRIEF DESCRIPTION OF DRAWINGS

The objects, features, and achieved efficacies of the invention can be understood from the description and drawings of the following preferred embodiments, in which.

DETAILED DESCRIPTION OF THE INVENTION

Figure 1:
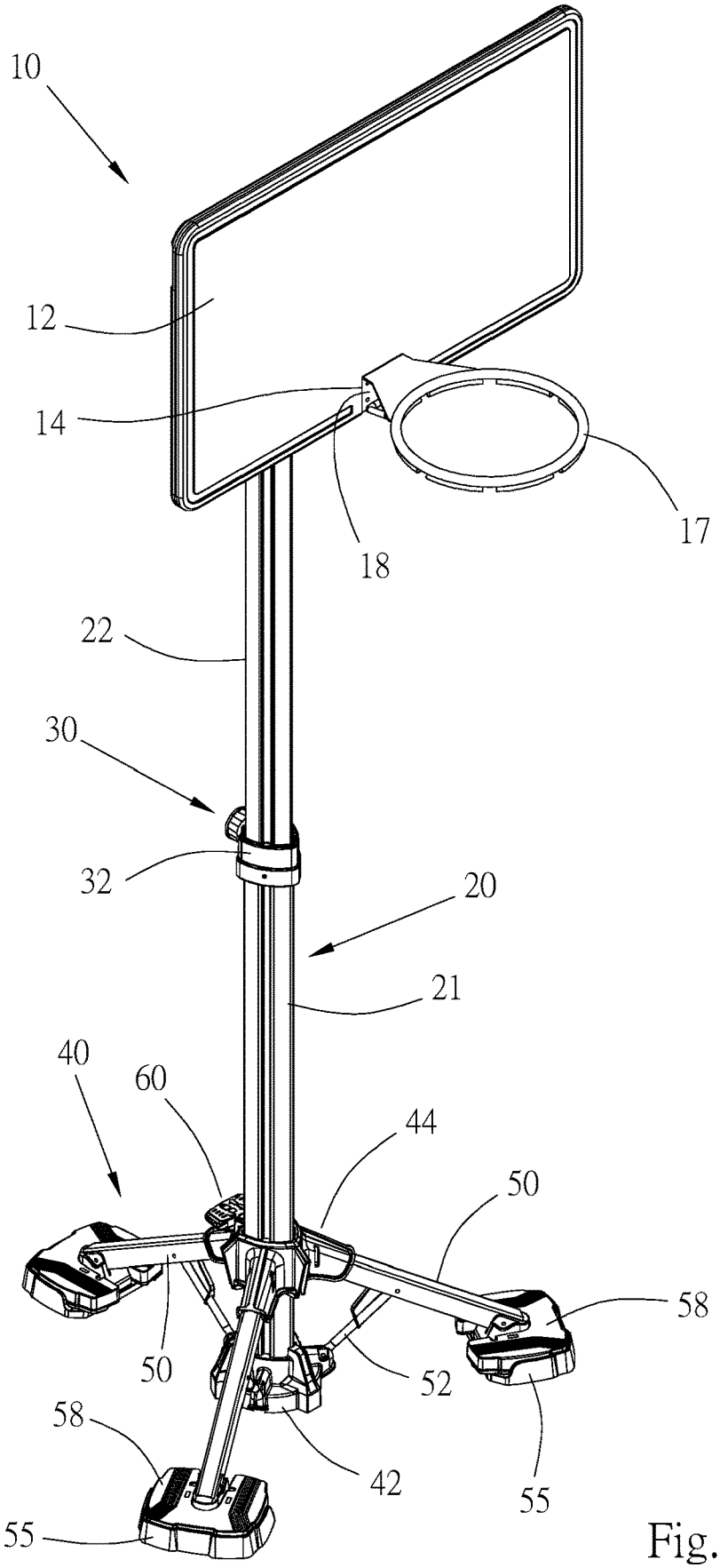
FIG. 1 is a front perspective view of a basketball stand according to a preferred embodiment of the invention.
Figure 2:
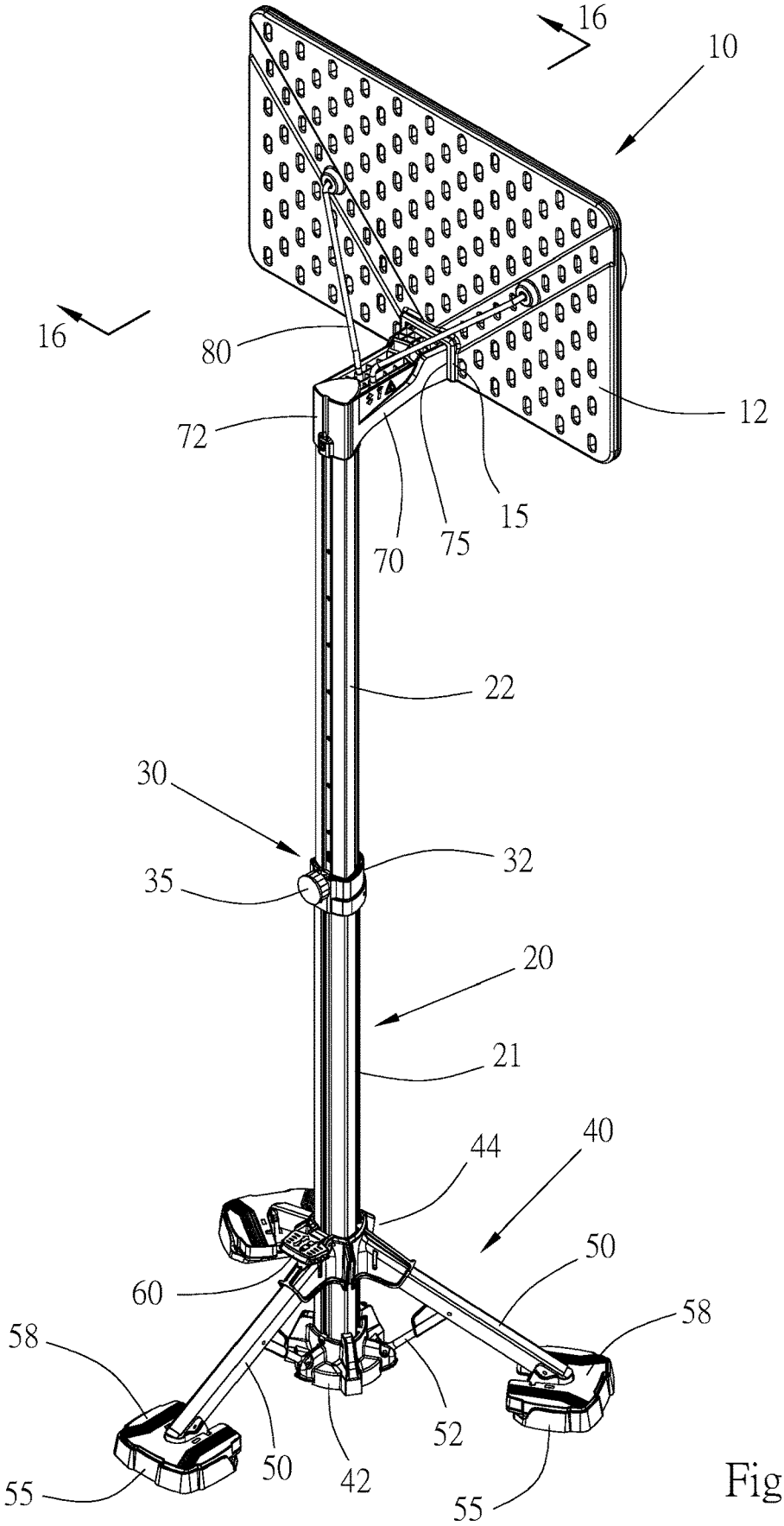
FIG. 2 is a rear perspective view of FIG. 1.

Please refer to FIGS. 1 and 2 for a basketball stand 10 provided by a preferred embodiment of the invention. The basketball stand 10 mainly comprises a main pole 20, a backboard 12, a basket 17, and a base assembly 40 provided on a bottom side of the main pole 20. The base assembly 40 can be unfolded so that the basketball stand 10 can be erected, and the base assembly 40 can be folded to save a volume of the basketball stand 10 and facilitate moving. The base assembly 40 has a counterweight design to make the basketball stand 10 stable and uneasy to tip over when in use.

Figure 3:
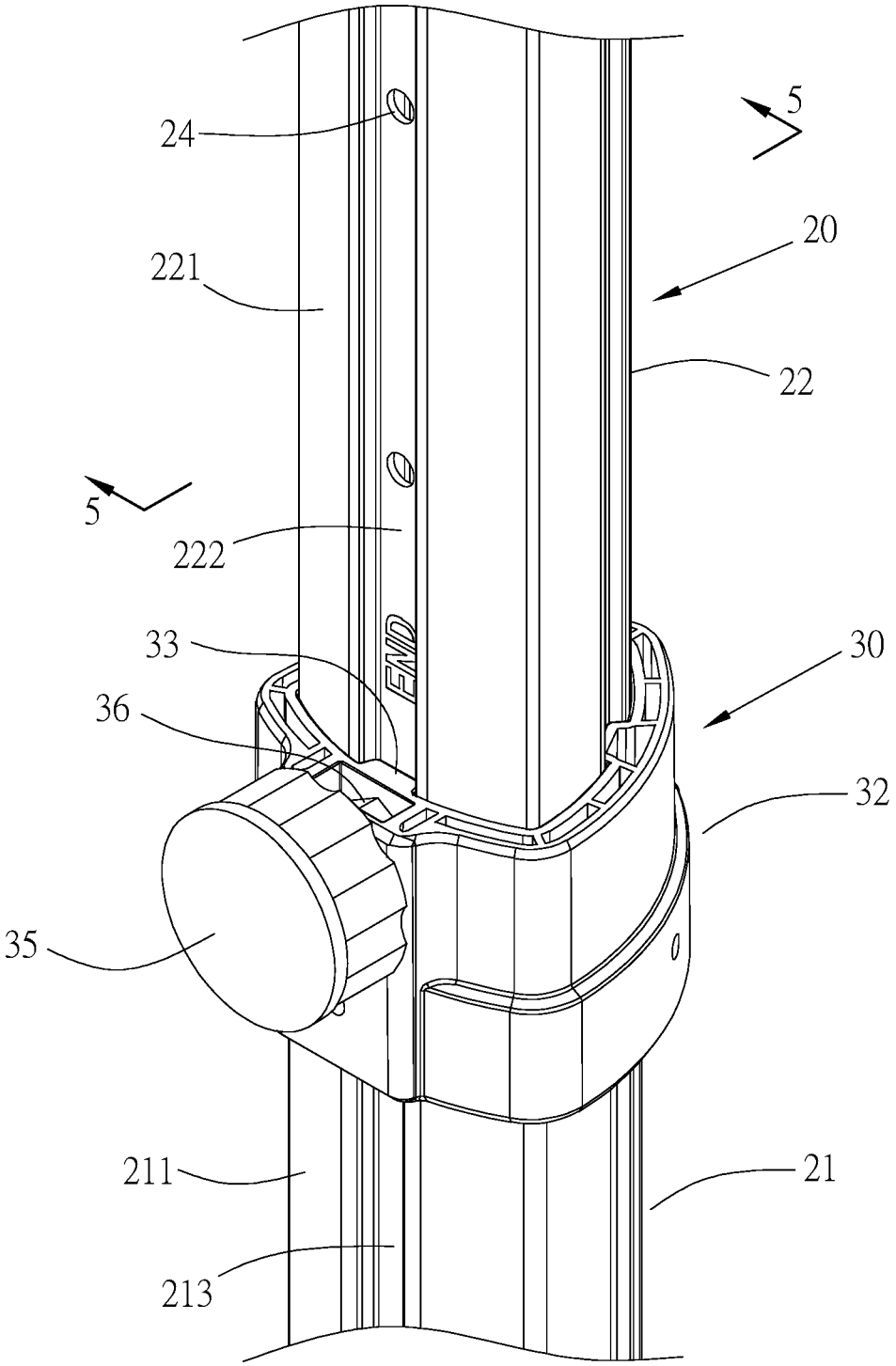
FIG. 3 shows a perspective view of a main pole and an adjustment mechanism.
Figure 4:
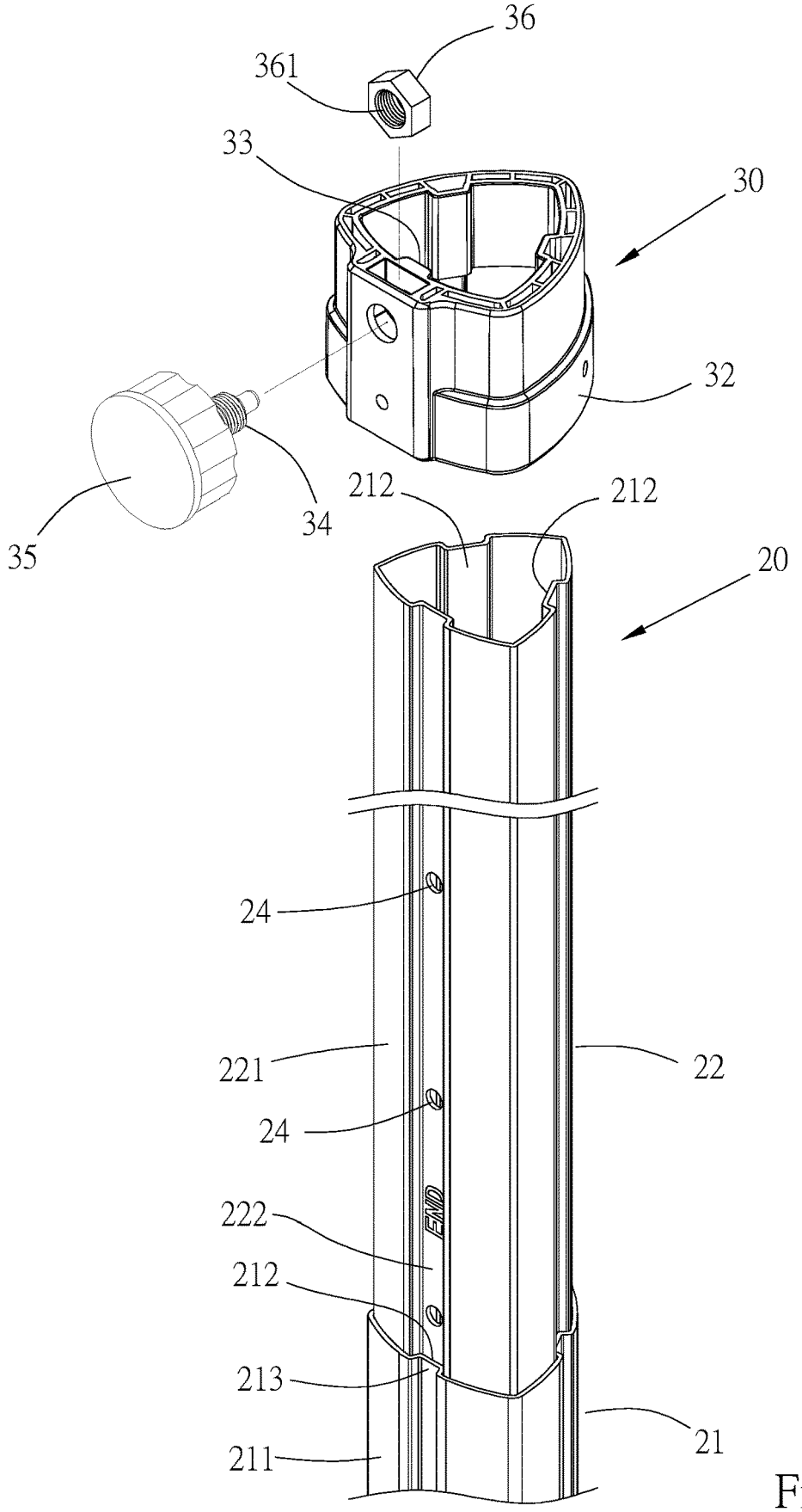
FIG. 4 is an exploded perspective view of FIG. 3.
Figure 6:
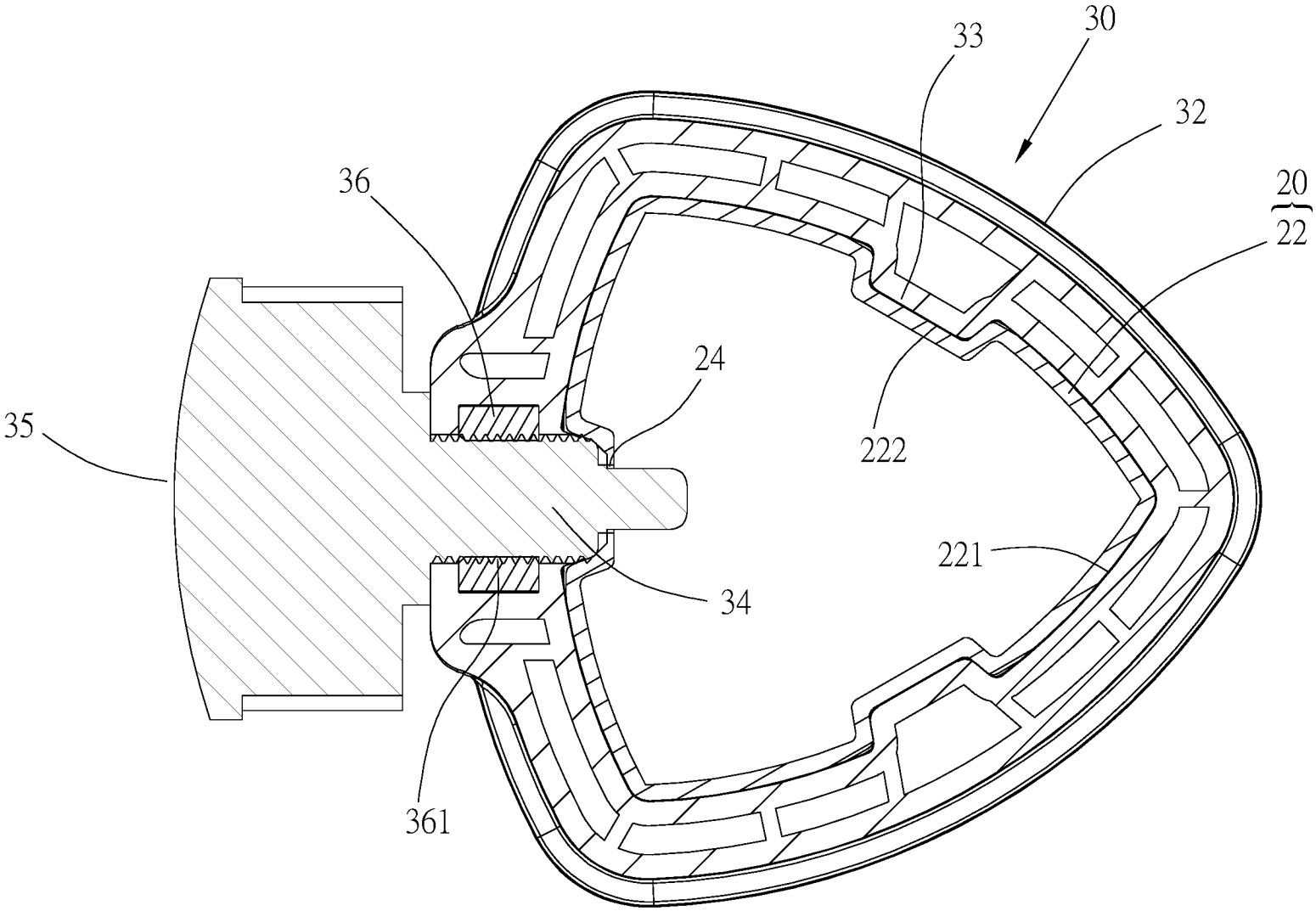
FIG. 6 is a cross-sectional view along section line 6-6 in FIG. 5.

Please refer to FIG. 3, FIG. 4 and FIG. 6. The main pole 20 has an inner pole 22 and a hollow outer pole 21, the inner pole 22 is telescopically receivable in the outer pole 21, so that the outer pole 21 and the inner pole 22 are capable of moving relative to each other to adjust a length of the main pole 20; one end of the inner pole 22 protrudes from one end (a top end) of the outer pole 21 to form a top end (a first end) of the main pole 20; one end (a bottom end) of the outer pole 21 away from the inner pole 22 forms a bottom end (a second end) of the main pole 20. Preferably, the inner pole 22 and the outer pole 21 are both tubular, cross-sectional shapes of the outer pole 21 and the inner pole 22 are non-circular. In this embodiment, the cross-sections of them are in the shape of a triangular shield, and three sides 211, 221 of the outer pole 21 and the inner pole 22 respectively are convex arcuate surfaces. Through the design of the cross-sectional shape, each of the sides 221 of the inner pole 22 and each of the sides 211 of the outer pole 21 are in contact with each other, so that peripheral surfaces of the inner pole 22 and the outer pole 21 are closely sleeved with each other to reduce a gap therebetween, prevent loosening, and reduce twisting between the outer pole 21 and the inner pole 22. In addition, in a longitudinal direction of the outer pole 21, each of the sides 211 is provided with an inwardly protruding convex strip 212, and each of the convex strips 212 is embedded with a longitudinal embedding slot 222 provided on each of the sides 221 of the inner pole 22. Through embedding between the convex strip 212 and the embedding slot 222, loosening or twisting between the inner pole 22 and the outer pole 21 can be avoided or reduced. The inner pole 22 is provided with a plurality of positioning holes 24 disposed at appropriate intervals along a longitudinal direction.

Figure 5:
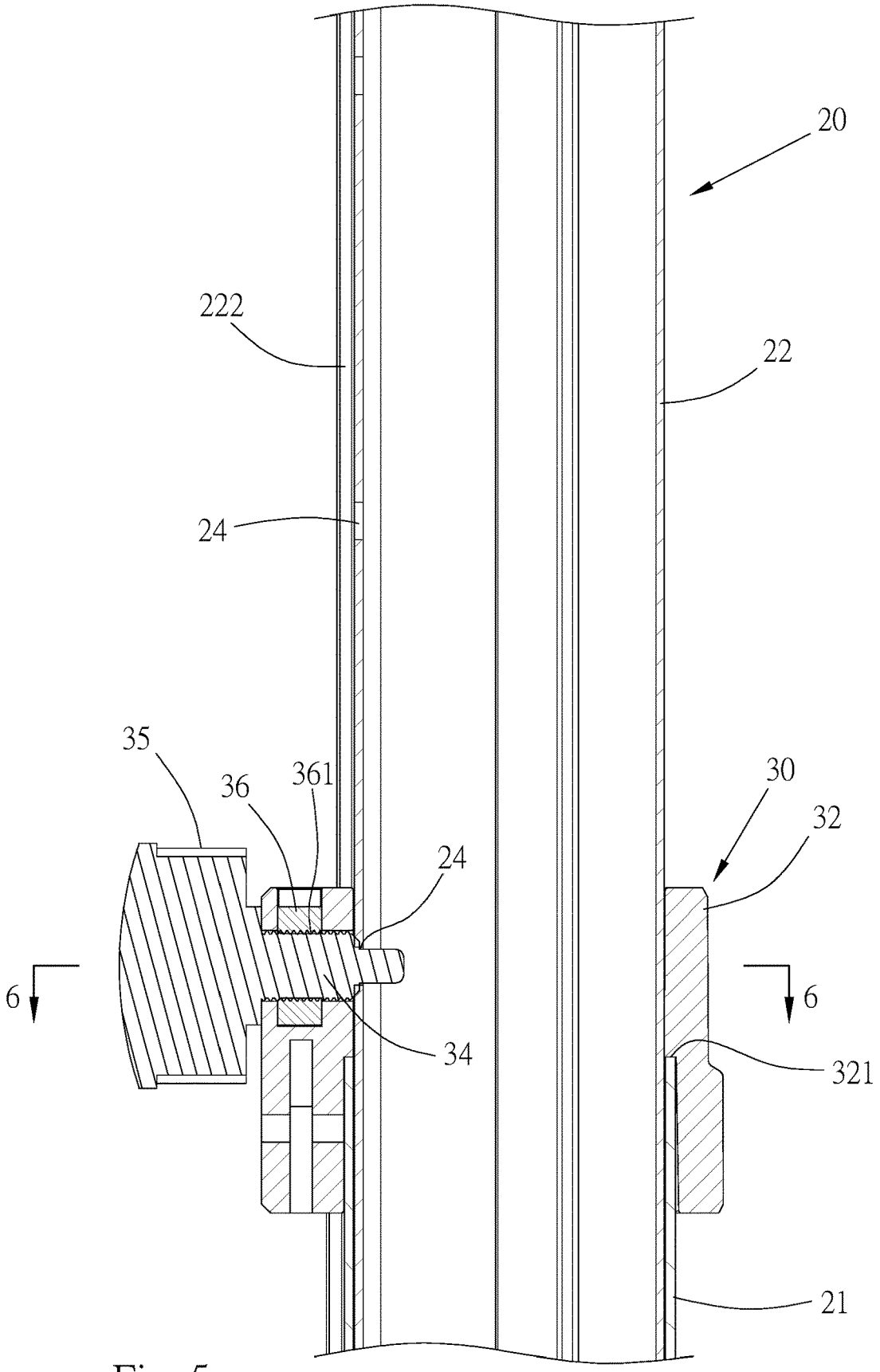
FIG. 5 is a cross-sectional view along section line 5-5 in FIG. 3.

Please refer to FIGS. 3 to 6, a positioning component 30 provided has a hollow end sleeve 32 and a positioning pin 34. One end of the positioning pin 34 is provided with a knob 35 for rotating the positioning pin 34. In this embodiment, the end sleeve 32 is sleeved on the top end of the outer pole 21, and a shoulder surface 321 provided on an inner peripheral surface of the end sleeve 32 is supported by an end edge of the outer pole 21, as shown in FIG. 5. A contour of the inner peripheral surface of the end sleeve 32 is consistent with a contour of an inner peripheral surface of the outer pole 21, so that the inner pole 22 is capable of sliding freely. The inner peripheral surface of the end sleeve 32 and an outer peripheral surface of the inner pole 22 are closely sleeved with each other, and a sleeved connection state between the end sleeve 32 and the outer pole 21 is the same as a sleeved connection state between the inner pole 22 and the outer pole 21. The inner peripheral surface of the end sleeve 32 corresponds to a cross-sectional shape of the outer pole 21, which is in the shape of a triangular shield. Each side of the end sleeve 32 is an arcuate surface and has an inwardly protruding portion 33 with a contour the same as that of the convex strip 212 of the outer pole 21. The protruding portion 33 is embedded with the embedding slot 222 of the inner pole 22. A threaded component, being a nut 36, is embedded in the end sleeve 32 to provide a threaded hole 361 for the outer pole 21. The positioning pin 34 is screwed into the threaded hole 361 of the end sleeve 32 of the outer pole 21. When the positioning pin 34 is rotated in one direction, the positioning pin 34 is capable of moving toward the inner pole 22 and inserting into a positioning hole 24 to position the inner pole 22 and the outer pole 21 of the main pole 20 at an adjusted length. When the positioning pin 34 is rotated in another direction, the positioning pin 34 is capable of moving out of the positioning hole 24 so that the inner pole 22 and the outer pole 21 are capable of sliding relative to each other to adjust the main pole 20 to different lengths.

Figure 7:
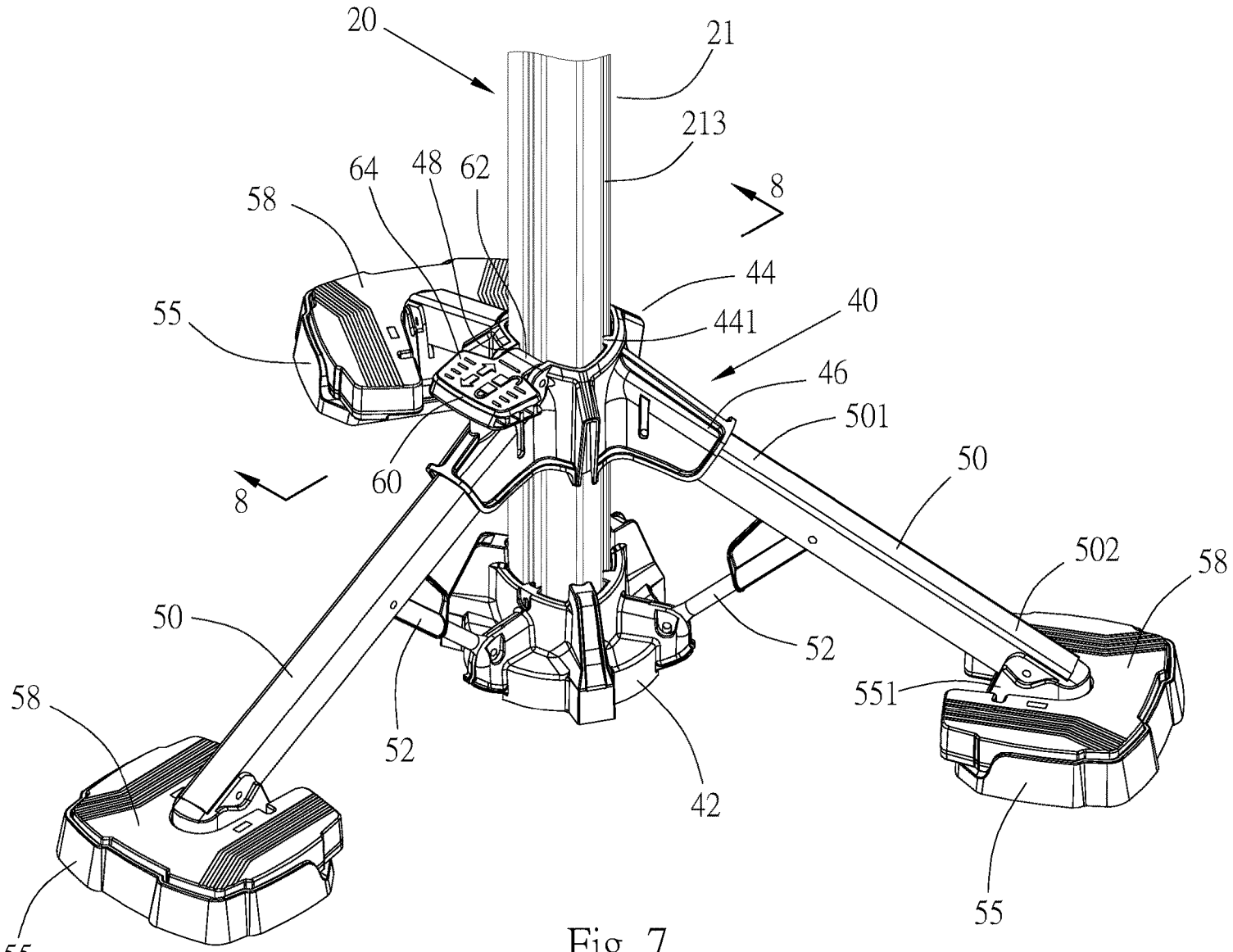
FIG. 7 is a perspective view of a base assembly of the basketball stand in FIG. 1, and shows the base assembly in an unfolded state.
Figure 8:
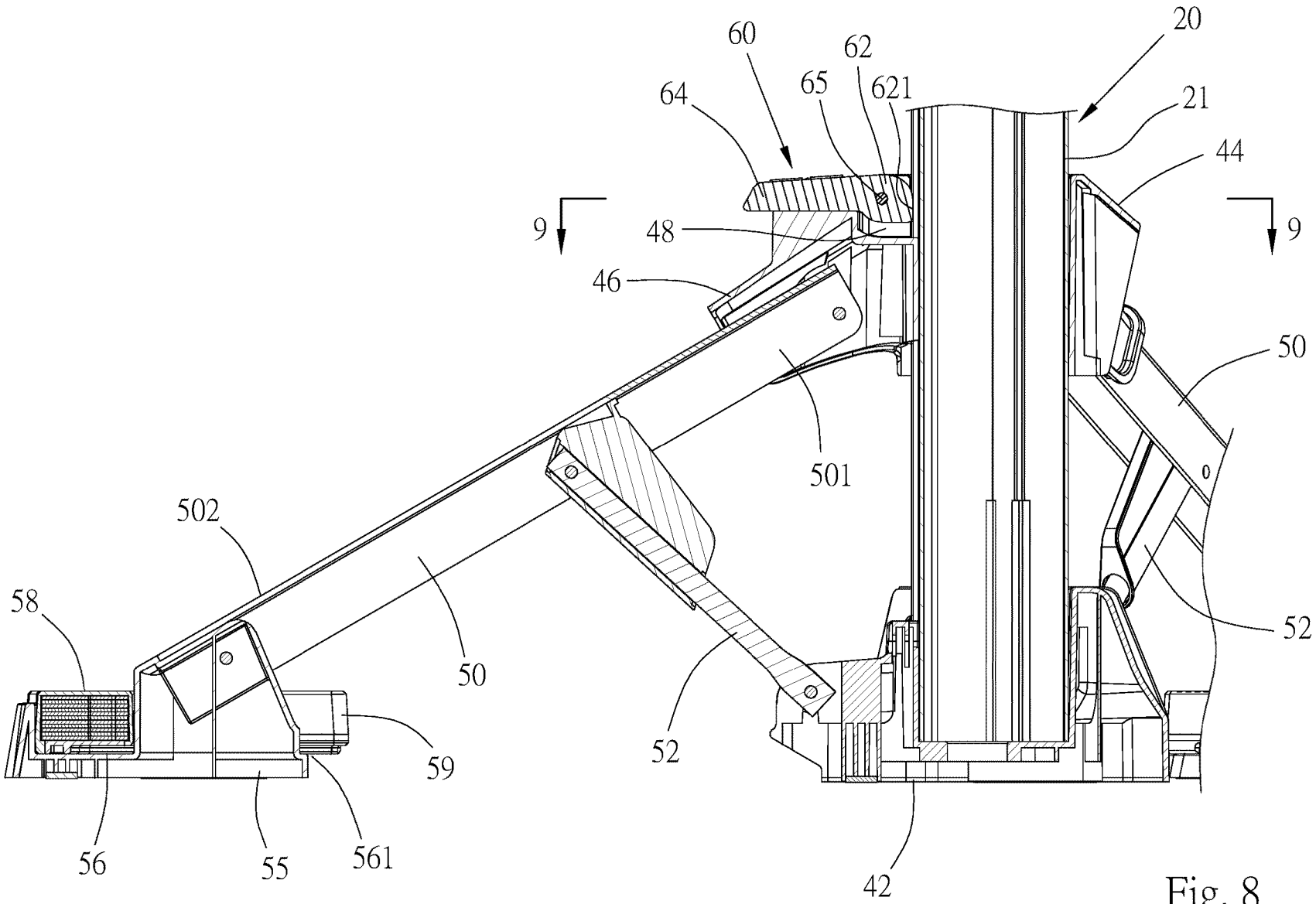
FIG. 8 is a cross-sectional view along section line 8-8 in FIG. 7.

Please refer to FIGS. 7 and 8. The base assembly 40 is installed at the bottom end of the main pole 20. The base assembly 40 mainly comprises at least three support poles 50, at least three support pads 55 and at least three weight blocks 58. The support poles 50 are annularly disposed around the main pole 20 at intervals. A top end of the support pole 50 can be directly or indirectly pivotally connected to the main pole 20, and a bottom end of the support pole 50 is capable of expanding outwardly or retracting inwardly. The support pads 55 are respectively connected to the bottom ends of the support poles 50, and the at least three weight blocks 58 can be installed on the support pads 55 respectively.

The base assembly 40 of this preferred embodiment has a fixed seat 42, a sliding seat 44, the at least three support poles 50, at least three connecting rods 52, the at least three support pads 55 and the at least three weight blocks 58, a quantity of the support poles 50, the connecting rods 52 and the support pads 55 can be more than three, such as four, five or six. This embodiment takes three as an example.

The fixed seat 42 is fixedly disposed on the bottom end of the main pole 20 and does not move.

The sliding seat 44 is a hollow cylindrical body that is sleeved on the main pole 20 and disposed above the fixed seat 42, and capable of sliding along a longitudinal direction of the main pole 20 to move away from or approach the fixed seat 42. Please refer to FIG. 9. An inner peripheral surface of the sliding seat 44 corresponds to a cross-sectional shape of the outer pole 21, which is in the shape of a triangular shield. Each side of the sliding seat 44 is provided with an inwardly protruding convex portion 441. Each of the convex portions 441 is embedded in a longitudinal embedding slot 213 provided on each of the sides 211 of an outer peripheral surface of the outer pole 21. Through sleeving connection between the inner peripheral surface of the sliding seat 44 and the outer peripheral surface of the outer pole 21 and embedding connection between the convex portion 441 and the embedding slot 213, a gap between the sliding seat 44 and the outer pole 21 is small, and the sliding seat 44 is stably sleeved on the outer peripheral surface of the outer pole 21. No matter whether the sliding seat 44 is in a stationary state or moves on the outer pole 21, it is not easy to loosen or shake.

The three support poles 50 and the three connecting rods 52 are annularly disposed around the main pole 20 at intervals. A top end 501 of each of the support poles 50 is pivotally connected to a lug 46 of the sliding seat 44, and a bottom end 502 thereof is capable of expanding outwardly or retracting inwardly. The top end 501 of the support pole 50 in this embodiment is indirectly pivotally connected to the main pole 20 through the sliding seat 44.

The three connecting rods 52 respectively correspond to the three support poles 50, one end of each of the connecting rods 52 is pivotally connected to the fixed seat 42, another end thereof is pivotally connected to the support rod 50. A linkage mechanism formed by the main pole 20, the support poles 50 and the connecting rods 52 enables the support poles 50 to expand outwardly as shown in FIG. 7, or retract inwardly as shown in FIG. 12.

Figure 10:
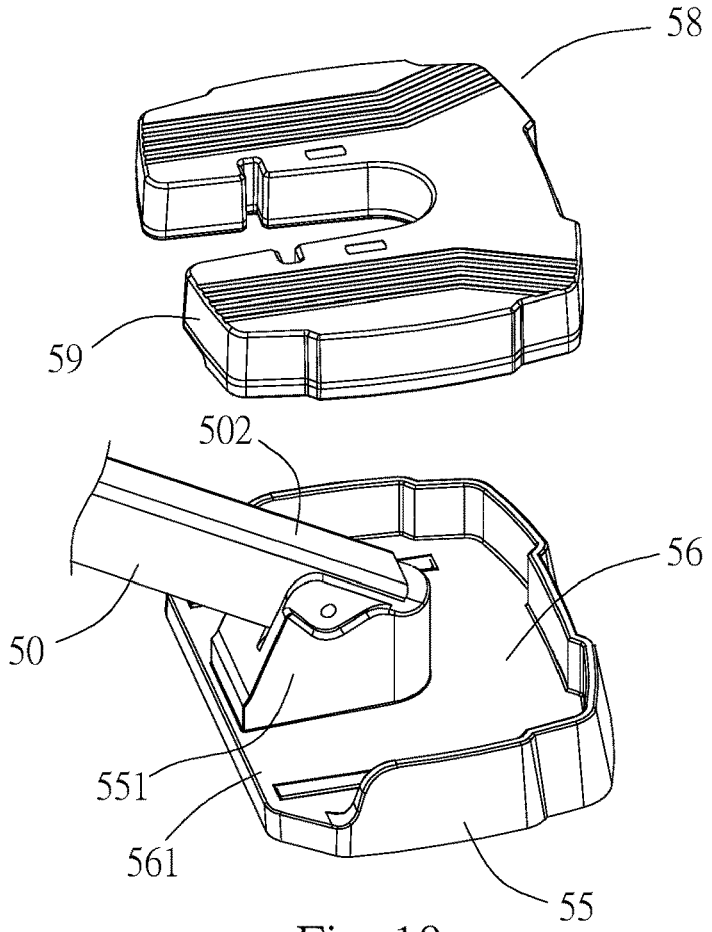
FIG. 10 is a perspective view of a support pad and a weight block of the base assembly.
Figure 11:
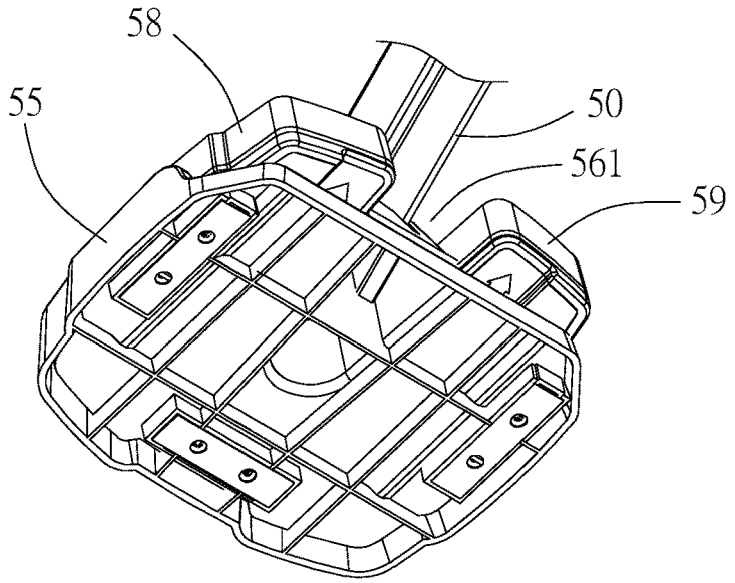
FIG. 11 shows a bottom perspective view of the support pad and the weight block.

Please refer to FIG. 10 and FIG. 11. The three support pads 55 are respectively pivotally connected to the bottom ends 502 of the three support poles 50. Each of the support pads 55 is provided with at least one non-sealed accommodating chamber 56, the accommodating chamber 56 in this embodiment is recessed inwardly from a top surface of the support pad 55, and a top surface and one side 561 of the accommodating chamber 56 are open. Preferably, the open side 561 is an inner side of the support pad 55, facing the main pole 20. A protrusion 551 is located in the accommodating chamber 56; the bottom end 502 of each of the support poles 50 is pivotally connected to the protrusion 551. The accommodating chamber 56 of each of the support pads 55 is equipped with at least one of the weight blocks 58. In this embodiment, each of the accommodating chambers 56 is equipped with a weight block 58. The weight block 58 is in a horseshoe shape and matches a U-shape of the accommodating chamber 56. Each of the weight blocks 58 can be accommodated in each of the accommodating chambers 56 and can be taken out, and the weight block 58 surrounds the protrusion 551. When the weight block 58 is installed into the accommodating chamber 56, the weight block 58 is limited by a peripheral wall of the accommodating chamber 56 and the protrusion 551 and confined in the accommodating chamber 56 and does not move. A user can take out the weight block 58 from the open side 561 of the accommodating chamber 56. Please refer to FIG. 11, one end 59 of the weight block 58 forms a fork portion, and the end 59 is exposed from the support pad 55 from the open side 561 of the accommodating chamber 56 to facilitate the user to take out the weight block 58 from the accommodating chamber 56. When the base assembly 40 is unfolded, the base assembly 40 is in contact with the ground via the support pads 55.

Figure 9:
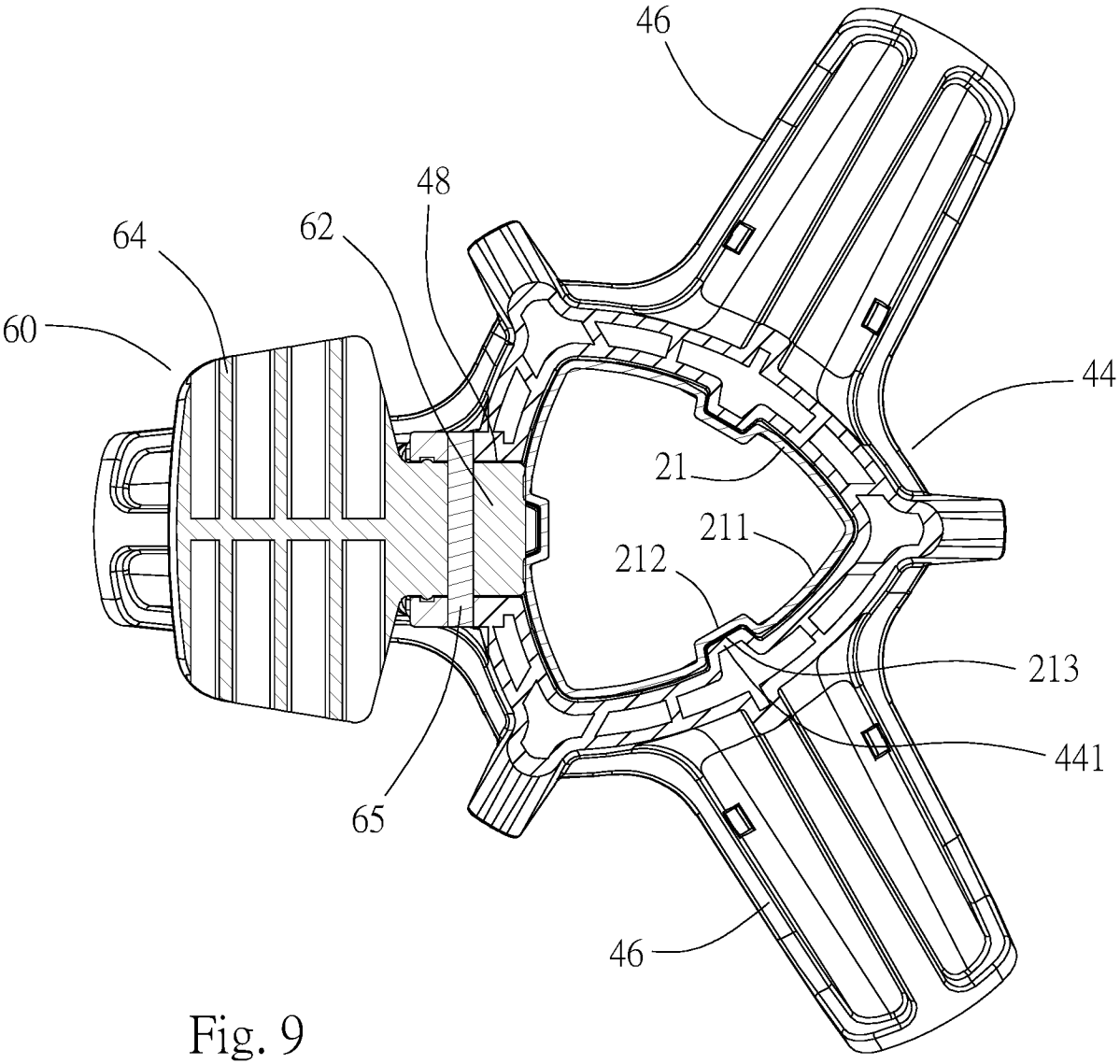
FIG. 9 is a cross-sectional view along section line 9-9 in FIG. 8.

Please refer to FIGS. 7 to 9. The basketball stand 10 of the invention further comprises a pressing member 60 pivotally disposed in a notch 48 provided on a peripheral wall of the sliding seat 44 and capable of contacting the outer pole 21 from the notch 48. The pressing member 60 is capable of switching between a pressing position and a release position. When the pressing member 60 is in the pressing position, the pressing member 60 presses against the main pole 30 to position the sliding seat 44. In detail, the pressing member 60 has a cam end 62 and a pulling portion 64 connected to the cam end 62. The cam end 62 is disposed in the notch 48 and pivotally connected to the sliding seat 44 with a shaft 65. The user can pull the pressing member 60 to rotate via the pulling portion 64. When the pressing member 60 is pulled to move to the pressing position shown in FIGS. 7 to 9, an outermost protruding portion 621 of the cam end 62 presses against the outer peripheral surface of the outer pole 21 to position the sliding seat 44.

Figure 12:
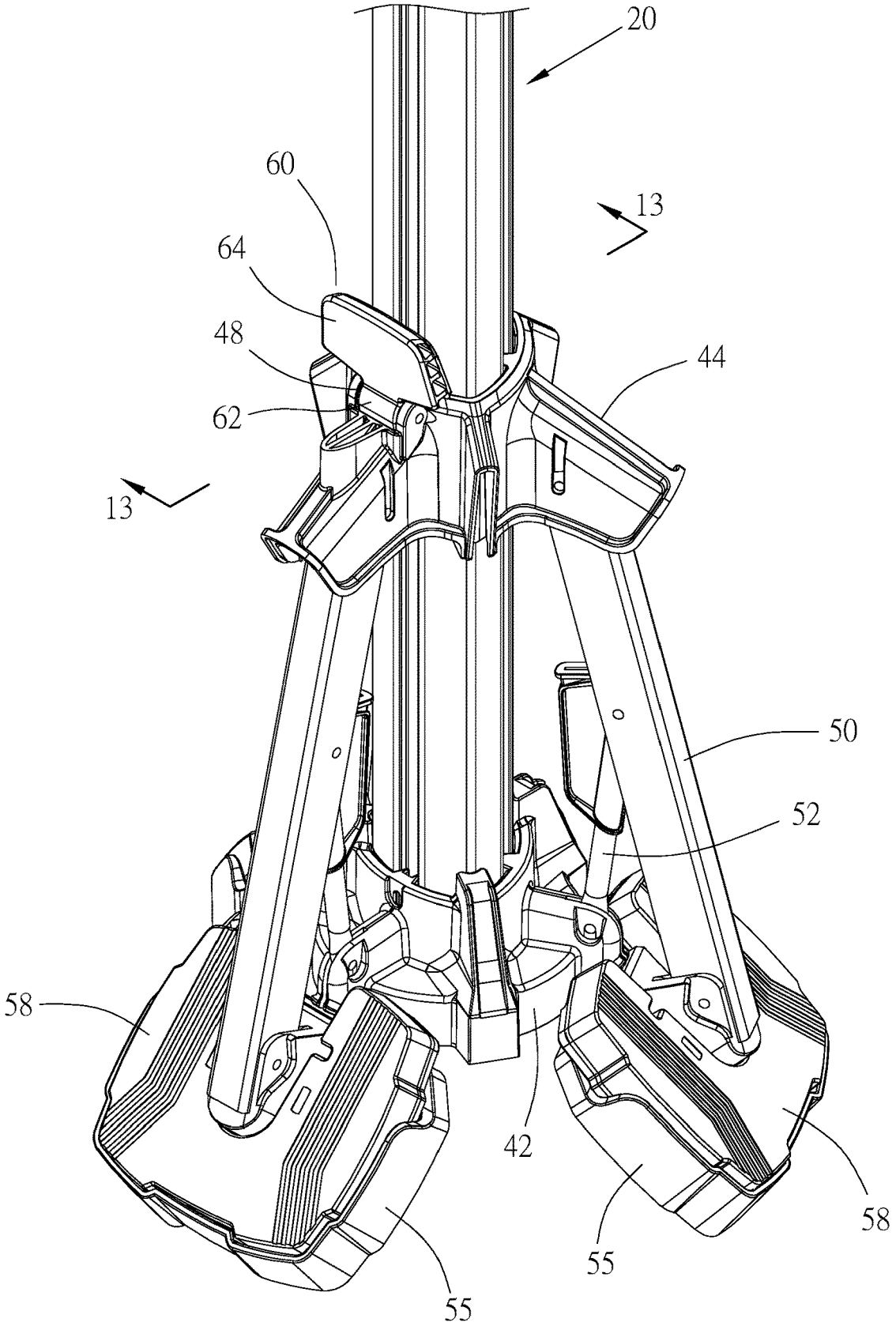
FIG. 12 is a partial perspective view of FIG. 2, showing the base assembly in a folded state.
Figure 13:
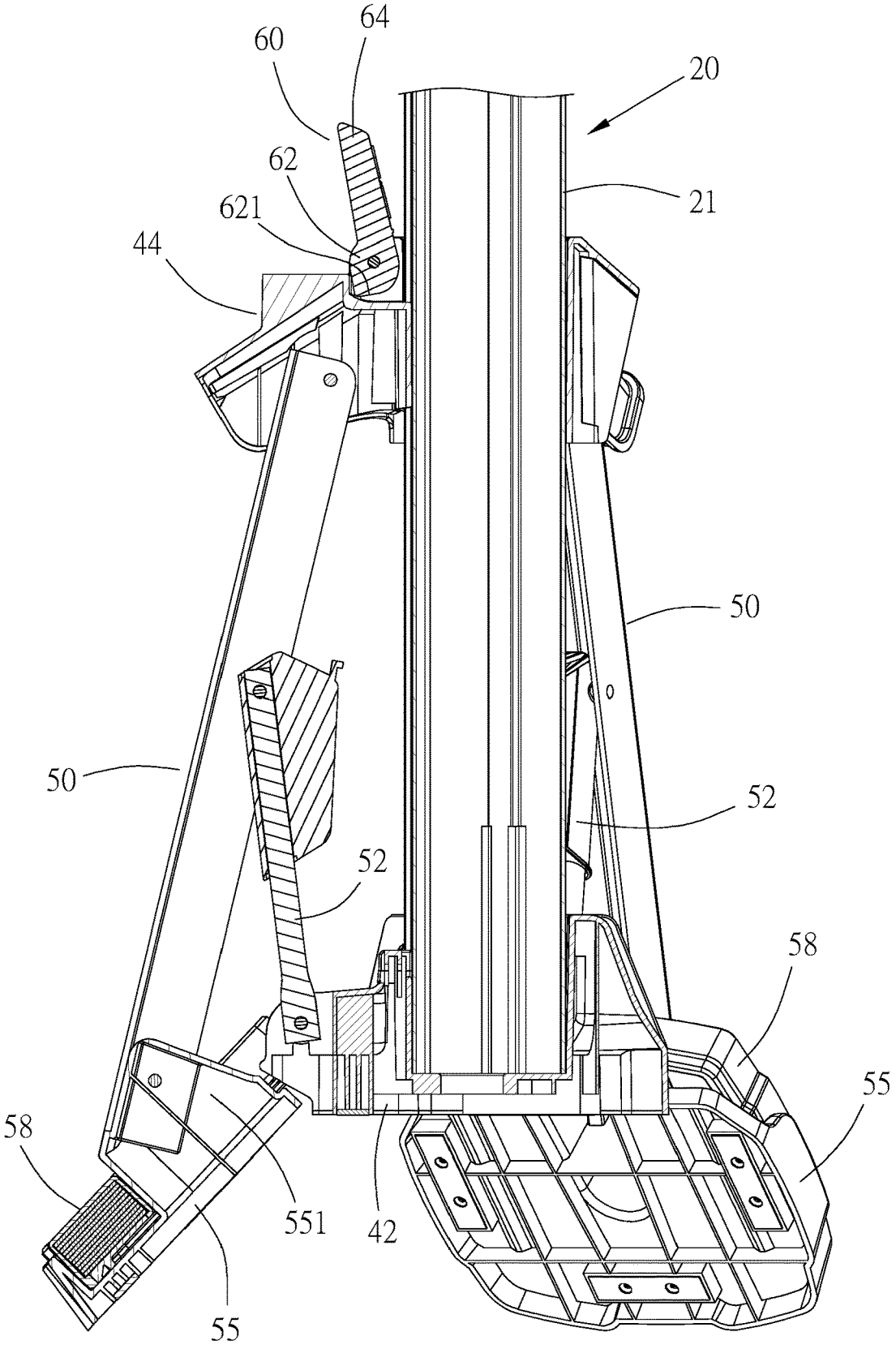
FIG. 13 is a cross-sectional view along section line 13-13 in FIG. 12.

When the pressing member 60 is pulled to move to the release position shown in FIGS. 12 and 13, the outermost protruding portion 621 of the cam end 62 no longer presses against the outer peripheral surface of the outer pole 21, the pressing member 60 is released from pressing against the outer pole 21, and the sliding seat 44 is capable of moving. The user moves the sliding seat 44 upward to move the three support poles 50 and the three connecting rods 52 together, so that the three support poles 50 are retracted toward the main pole 20, and the base assembly 40 is folded in a folded state as shown in FIG. 12 and FIG. 13 to facilitate moving and storage of the basketball stand 10. When the basketball stand 10 needs to be used, the base assembly 40 is unfolded in an unfolded state as shown in FIG. 7, and the pressing member 60 is pulled to move to the pressing position to position the sliding seat 44 so that the base assembly 40 is maintained in an unfolded state.

The backboard 12 and the basket 17 of the basketball stand 10 in this embodiment are installed on the top end of the main pole 20 through a bracket 70.

Figure 14:
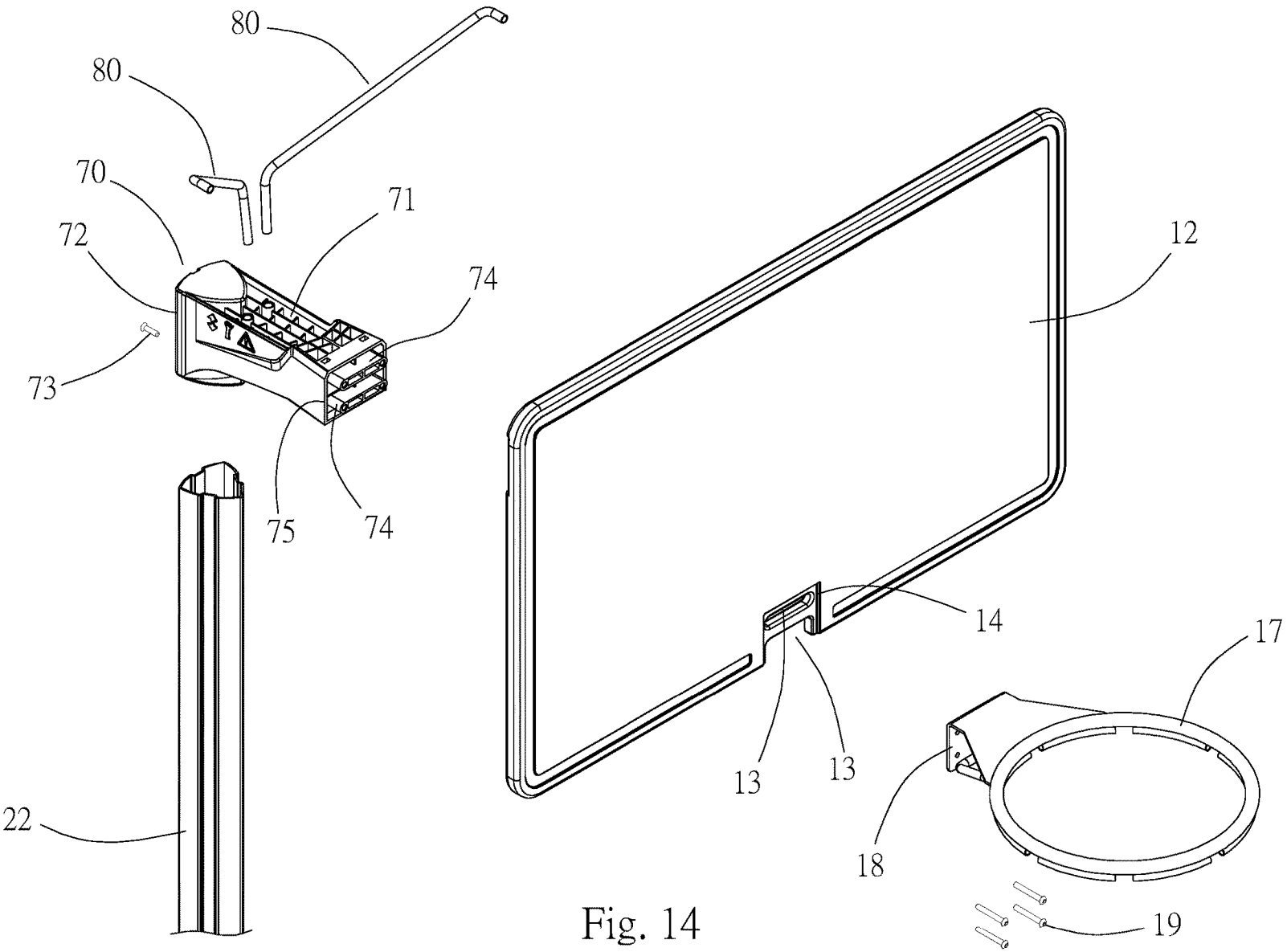
FIGS. 14 and 15 are partially exploded perspective views of FIGS. 1 and 2, showing a backboard and a bracket.
Figure 15:
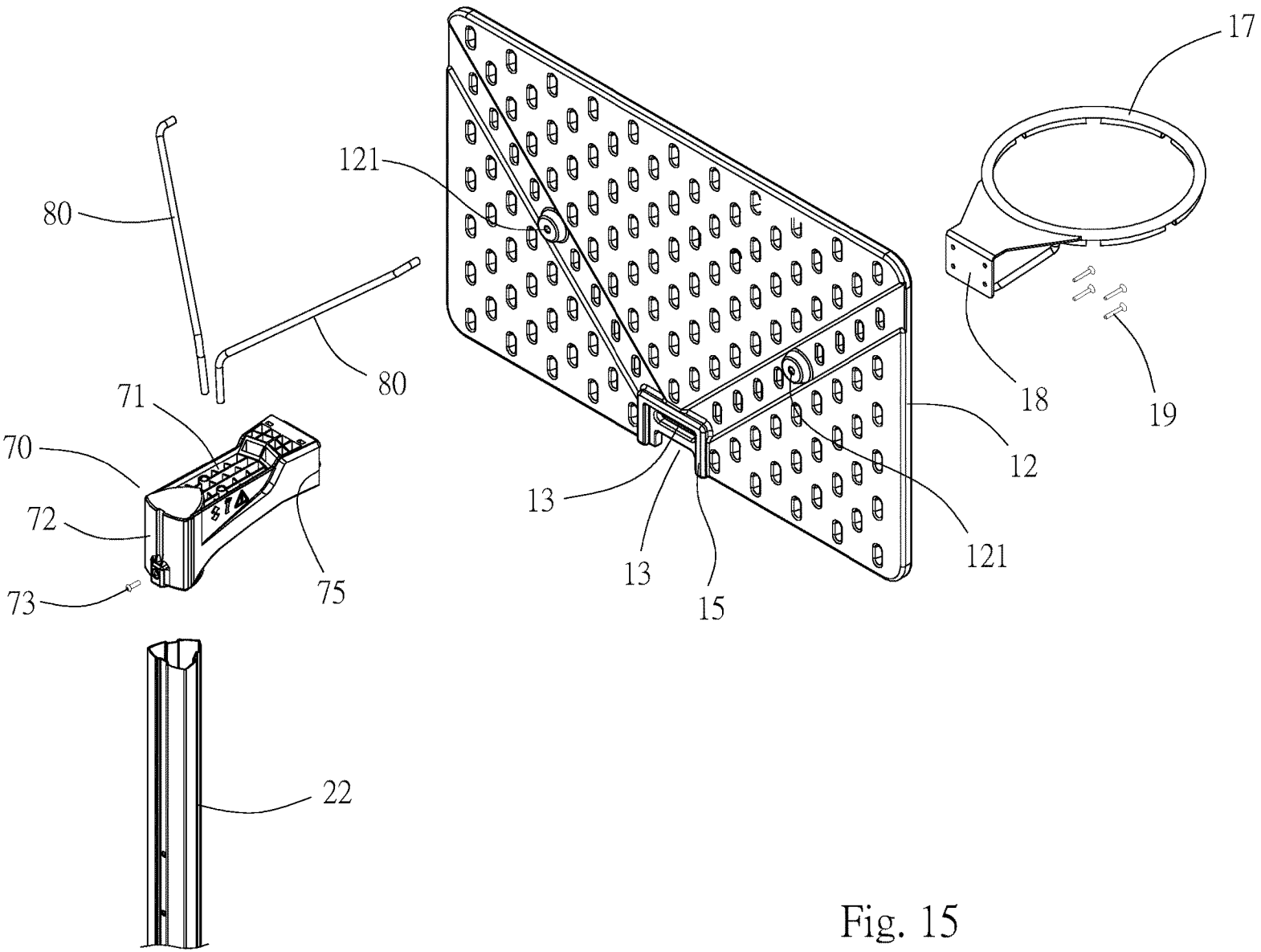
Figure 16:
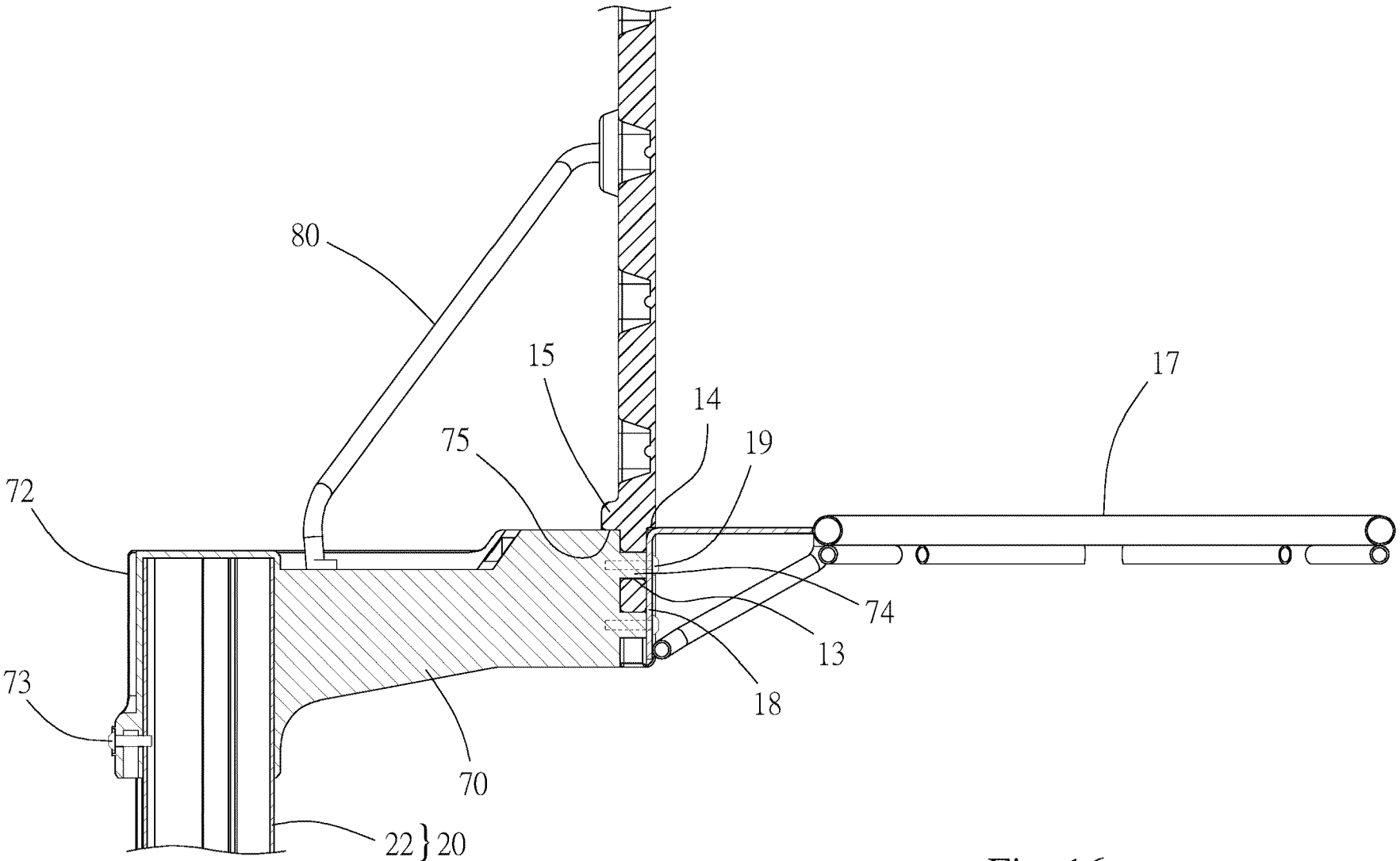
FIG. 16 is a cross-sectional view along section line 16-16 in FIG. 2.

Please refer to FIGS. 14 to 16, the bracket 70 has a front end and a rear end, the rear end is detachably connected to the top of the main pole 20; and the backboard 12 and the basket 17 are assembled to the front end of the bracket 70.

A socket portion 72 is provided at the rear end of the bracket 70. The bracket 70 is sleeved on a top end of the inner pole 22 of the main pole 20 via the socket portion 72. The socket portion 72 is provided with a pressing element 73 being a bolt, when the pressing element 73 is turned tightly, the pressing element 73 can be pressed against the inner pole 22 so that the socket portion 72 will not separate from the inner pole 22. When the pressing element 73 is turned loosely, the pressing element 73 is no longer pressing against the inner pole 72, and the bracket 70 can be separated from the main pole 20. The front end of the bracket 70 is provided with one plug post 74 or a plurality of plug posts 74 protruding forward, a peripheral wall of the front end of the bracket 70 forms a non-circular periphery 75, and the periphery 75 is rectangular in this embodiment.

A bottom edge of the backboard 12 is provided with one inserting slot 13 or a plurality of inserting slots 13 penetrating through a front side and a back side of the backboard 12; a first position-limiting portion being a position-limiting recess 14 is recessed at a position on the front side of the backboard 12 near the inserting slot 13. A second position-limiting portion, in this embodiment, being a protruding position-limiting frame 15, is disposed at a position on the back side of the backboard 12 near the inserting slot 13. A geometric shape of the position-limiting frame 15 corresponds to a geometric shape of the periphery 75 of the bracket 70.

The rear end of the basket 17 has a connecting plate 18, a geometric shape of the connecting plate 18 corresponds to a shape of the position-limiting recess 14. The connecting plate 18 and the position-limiting recess 14 have non-circular geometric shapes, which are rectangular in this embodiment.

The front end of the bracket 70 and the connecting plate 18 of the basket 17 pass through the backboard 12 and are connected with each other. When the bracket 70 and the connecting plate 18 are connected with each other, the backboard 12 is clamped therebetween. As shown in FIG. 16, the plug posts 74 at the front end of the bracket 70 are inserted into the inserting slots 13 from the back side of the backboard 12, the periphery 75 is located in the position-limiting frame 15 and engages with the position-limiting frame 15, so that the bracket 70 and the backboard 12 are firmly connected with each other and do not rotate relative to each other. The connecting plate 18 at the rear end of the basket 17 is placed into the position-limiting recess 14 on the front side of the backboard 12 and engaged with the position-limiting recess 14, so that the basket 17 and the backboard 12 are firmly connected with each other and do not rotate relative to each other. Four connecting elements 19, such as screws, pass through the inserting slots 13 of the backboard 12 and are connected to the connecting plate 18 of the basket 17 and the plug posts 74 of the bracket 70, thereby the backboard 12 and the basket 17 are assembled at the front end of the bracket 70. An insertion structure of the two plug posts 74 inserted into the two inserting slots 13 is capable of preventing the backboard 12 and the bracket 70 from rotating relative to each other. It should be noted that the first position-limiting portion can be a position-limiting frame to be engaged with the connecting plate 18 of the basket 17; the second position-limiting portion can be a position-limiting recess to be engaged with the periphery 75 at the front end of the bracket 70.

Two ends of two butt rods 80 are detachably plugged into insertion portions 71 on a top surface of the bracket 70 and insertion holes 121 on the back side of the backboard 12 respectively. Front ends of the two butt rods 80 butt against two sides of backboard 12, enabling the backboard 12 to withstand an impact force of a basketball.

The basketball stand 10 provided by the invention has the base assembly 40 capable of unfolding. When the base assembly 40 is unfolded, the support poles 50 are in contact with the ground via the support pads 55. Each of the support pad 55 has a large area so that the basketball stand 10 can be erected firmly and stably on the ground. The three support pads 55 form a large bottom area, enabling the basketball stand 10 to be provided with a large bottom area, which is difficult to tip over. Moreover, the base assembly 40 has a counterweight design, each of the support pads 55 is equipped with the detachable weight block 58 to increase a weight of the base assembly 40, enabling the basketball stand 10 to have a lower center of gravity and a more firm and stable bottom, thus it is less likely to tip over during use.

Operations of unfolding and folding the base assembly 40 and telescopic adjustment of the main pole 20 are quite easy and convenient. With connection and separation between the socket portion 72 of the bracket 70 and the main pole 20, the backboard 12 and the basket 17 can be assembled and disassembled, which is easy to operate.

Matching structures of the outer pole 21 and the inner pole 22 of the main pole 20, connection structures of the sliding seat 44 and the outer pole 22, and connection structures of the bracket 70, the backboard 12 and the basket 17 are very stable and firm, making an overall structure of the basketball stand 10 stable and not prone to loosening.

Although the invention has been disclosed as above with the embodiments, it is not intended to limit the invention. A person having ordinary skill in the art to which the invention pertains can make various changes and modifications without departing from the spirit and scope of the invention. Therefore, the scope of protection of the invention shall be subject to what is defined in the pending claims.

What is claimed is:

1. A basketball stand comprising:

a main pole having a top end and a bottom end; and a base assembly installed on a bottom side of the main pole, and having at least three support poles, at least three connecting rods, at least three support pads and at least three weight blocks, wherein:

the support poles are annularly disposed around the main pole at intervals, a bottom end of each of the support poles is capable of expanding outwardly or retracting inwardly;

the connecting rods respectively correspond to the support rods poles, one end of each of the connecting rods is pivotally connected to the main pole, and another end thereof is pivotally connected to one of the support poles correspondingly;

the support pads are respectively pivotally connected to the bottom ends of the support poles;

the weight blocks are respectively installed on the support pads; and the support poles of the base assembly are capable of expanding or retracting, when the support poles are expanded, the support pads contact the ground;

wherein each of the support pads is provided with at least one accommodating chamber; and each of the weight blocks is detachably disposed in the at least one accommodating chamber.

2. The basketball stand as claimed in claim 1, wherein a top surface of each of the support pads is recessed inwardly with the at least one accommodating chamber, and each of the weight blocks is placed into the at least one accommodating chamber.

3. The basketball stand as claimed in claim 2, wherein a protrusion is located in the at least one accommodating chamber; the bottom end of each of the support poles is pivotally connected to the protrusion; and each of the weight blocks is U-shaped to surround the protrusion.

4. The basketball stand as claimed in claim 3, wherein one side of the at least one accommodating chamber forms an open side; one end of the weight block is exposed from the support pad from the open side of the at least one accommodating chamber.

5. The basketball stand as claimed in claim 2, wherein one side of the at least one accommodating chamber forms an open side.

6. The basketball stand as claimed in claim 1, wherein the base assembly further comprises a fixed seat and a sliding seat, the fixed seat is fixedly disposed on a bottom end of the main pole; the sliding seat is sleeved on the main pole and located above the fixed seat, and capable of sliding along a longitudinal direction of the main pole; a top end of each of the support poles is pivotally connected to the sliding seat; one end of each of the connecting rods is pivotally connected to the fixed seat, and another end thereof is pivotally connected to one of the support poles correspondingly.

7. The basketball stand as claimed in claim 6 further comprising a pressing member having a cam end and a pulling portion connected to the cam end, the cam end of the pressing member being pivotally connected to the sliding seat, the pressing member being capable of switching between a pressing position and a release position, when the pressing member being located at the pressing position, the cam end pressing against the main pole to position the sliding seat; when the pressing member being located at the release position, the cam end being not pressing the main pole.

8. The basketball stand as claimed in claim 1, wherein the main pole has an inner pole and a hollow outer pole, the inner pole is telescopically receivable in the outer pole and the poles are capable of moving relative to each other; a top end of the inner pole protrudes from a top end of the outer pole to form a top end of the main pole; a positioning component has a positioning pin, the positioning pin is inserted into the inner pole from the outer pole and can be withdrawn from the inner pole.

9. The basketball stand as claimed in claim 8, wherein the positioning component has an end sleeve disposed on the top end of the outer pole; a plurality of positioning holes are disposed on the inner pole along a longitudinal direction of the inner pole; the positioning pin passes through the end sleeve and is inserted into one of the positioning holes of the inner pole.

10. The basketball stand as claimed in claim 8, wherein an outer peripheral surface of the outer pole is provided with at least one longitudinal embedding slot; the sliding seat is a hollow body, an inner peripheral surface thereof is provided with at least one convex portion, the sliding seat is sleeved on the outer pole; the convex portion is embedded with the embedding slot.

11. The basketball stand as claimed in claim 1, wherein the main pole has an inner pole and a hollow outer pole, the inner pole is telescopically receivable in the outer pole and the poles are capable of moving relative to each other; cross-sections of the inner pole and the outer pole are in the shape of a triangular shield, three sides of the inner pole and the outer pole are convex arcuate surfaces, at least one of the sides of the inner pole is provided with a longitudinal embedding slot; at least one of the sides of the outer pole has a longitudinal convex strip, each of the sides of the inner pole is in contact with each of the sides of the outer pole, and the convex strip is embedded in the embedding slot.

12. The basketball stand as claimed in claim 1, further comprises a bracket, the bracket has a front end and a rear end, the rear end is connected to the main pole; at least one plug post is provided at the front end of the bracket; a bottom edge of a backboard is provided with at least one inserting slot penetrating through a front side and a back side of the backboard; a rear end of a basket has a connecting plate; the plug post of the bracket is inserted into the inserting slot from the back side of the backboard; the connecting plate of the basket is disposed on the front side of the backboard; and at least one connecting element is connected to the connecting plate of the basket and the plug post of the bracket.

13. The basketball stand as claimed in claim 1, further comprises a bracket, the bracket has a front end and a rear end, the rear a rear end is connected to the main pole, a peripheral wall of the front end of the bracket forms a non-circular periphery; a rear end of a basket has a connecting plate; a front side of a backboard is provided with a first position-limiting portion, a back side thereof is provided with a second position-limiting portion, a geometric shape of the first position-limiting portion corresponds to a geometric shape of the connecting plate; a geometric shape of the second position-limiting portion corresponds to a geometric shape of a periphery of the bracket; the connecting plate of the basket and the first position-limiting portion are engaged with each other; the periphery of the front end of the bracket and the second position-limiting portion are engaged with each other; and at least one connecting element is connected to the connecting plate and the front end of the bracket.

14. The basketball stand as claimed in claim 13, wherein the first position-limiting portion is a recess or a frame; the second position-limiting portion is a frame or a recess.

* * * * *